US008033361B2

(12) United States Patent
Maurer et al.

(10) Patent No.: US 8,033,361 B2
(45) Date of Patent: Oct. 11, 2011

(54) CONNECTION FOR GUIDE RAILS

(75) Inventors: Andreas Maurer, Zürich (CH); Pascal Mosetti, Niederlenz (CH)

(73) Assignee: Highstep Systems AG, Zurich (CH)

( * ) Notice: Subject to any disclaimer, the term of this patent is extended or adjusted under 35 U.S.C. 154(b) by 0 days.

(21) Appl. No.: 12/677,645

(22) PCT Filed: Sep. 4, 2008

(86) PCT No.: PCT/EP2008/061706

§ 371 (c)(1),
(2), (4) Date: Mar. 11, 2010

(87) PCT Pub. No.: WO2009/034010

PCT Pub. Date: Mar. 19, 2009

(65) Prior Publication Data

US 2010/0252645 A1 Oct. 7, 2010

(30) Foreign Application Priority Data

Sep. 11, 2007 (CH) ..... 1418/07

(51) Int. Cl.
*A47L 3/02* (2006.01)

(52) U.S. Cl. ..... 182/112; 182/134; 104/126; 238/123

(58) Field of Classification Search ..... 238/10 R, 238/10 A, 10 E, 10 F, 123, 151, 175, 176; 104/126, 106, 107, 108; 182/112, 134; 105/29.1, 105/29.2

See application file for complete search history.

(56) References Cited

U.S. PATENT DOCUMENTS 341,639 A * 5/1886 Clark ..... 187/270
3,884,153 A * 5/1975 Sugimoto ..... 104/93
3,968,858 A * 7/1976 Vollan et al. ..... 182/135
4,499,966 A * 2/1985 Milne et al. ..... 182/3
4,629,032 A * 12/1986 Armstrong ..... 182/9
4,709,782 A * 12/1987 Lipinski ..... 182/3
4,828,072 A * 5/1989 Ho ..... 182/9
4,838,412 A * 6/1989 Backman ..... 198/838
4,887,694 A * 12/1989 Ho ..... 182/82
6,161,647 A * 12/2000 Braden et al. ..... 182/8

(Continued)

FOREIGN PATENT DOCUMENTS

AU 567 801 B2 12/1987

(Continued)

OTHER PUBLICATIONS

International Search Report and Written Opinion; International Application No. PCT/EP2008/061706; International Filing Date Sep. 4, 2008.

*Primary Examiner* — Jason C Smith
(74) *Attorney, Agent, or Firm* — Antonelli, Terry, Stout & Kraus, LLP.

(57) ABSTRACT

A multipart rail-like profile comprises at least two or more joinable or insertable profile elements (1), having at least one ratchet (5), a toothed rack compartment, or codings extending in the longitudinal direction. In addition, pattern elements (11) having equidistantly spaced elements (13), which are coupled to the ratchet or toothed rack partitioning, are provided in at least one wall of each profile element (1). For connecting the joinable or insertable profile elements (1), a connecting element (21) having a further wall (23) is provided for adjoining the wall of each profile element, having further, longitudinally extending pattern elements (25) which are congruent with the pattern elements (11), the elements (27) of which have matching spacing.

14 Claims, 6 Drawing Sheets

U.S. PATENT DOCUMENTS

| | | | | |
|---|---|---|---|---|
| 2002/0014568 | A1* | 2/2002 | Faucher et al. | 248/354.3 |
| 2007/0189883 | A1* | 8/2007 | Maurer et al. | 414/373 |
| 2009/0218165 | A1* | 9/2009 | Maurer et al. | 182/112 |
| 2010/0252645 | A1* | 10/2010 | Maurer et al. | 238/123 |

FOREIGN PATENT DOCUMENTS

| | | | |
|---|---|---|---|
| DE | 10 12 320 | B | 7/1957 |
| DE | 103 19 175 | A1 | 1/2005 |
| DE | 103 37 121 | B3 | 6/2005 |
| EP | 1 506 799 | A | 2/2005 |
| FR | 2 547 859 | A | 12/1984 |
| WO | WO 2005/016461 | | 2/2005 |
| WO | WO 2007/051341 | | 5/2007 |

* cited by examiner

CONNECTION FOR GUIDE RAILS

RELATED APPLICATION

This application is a U.S. national phase application under 35 U.S.C. §371 of International Application No. PCT/EP2008/061706 filed Sep. 4, 2008, claiming priority under 35 U.S.C. §119 of Switzerland Application No. 1418/07 filed Sep. 11, 2007.

BACKGROUND AND SUMMARY

The present invention relates to a multipart rail-like profile comprising at least two or more joinable or insertable rail-like profile elements having at least one ratchet, a toothed rack compartment, or codings extending in the longitudinal direction, use of the profile, and methods for connecting two elements of a multipart rail-like profile.

For multipart rail-like profiles having a longitudinal ratchet or toothed rack compartment, it is a problem that in the transition from one profile to the next, the ratchet or toothed rack compartment continues with equidistant spacing. Since devices, means of transport, or vehicles are generally guided in the ratchet or toothed rack compartment or are driven by same, an imprecise transition results in interruptions of motion, reverse motions, or even the vehicle or device falling from the ratchet or toothed rack compartment.

Although it is possible to cut off the individual profile elements at the end in such a way that the transition is correct, this requires extremely accurate cutting equipment and a precise joining of the individual profile elements, which is very complicated.

The object of the present invention, therefore, is to provide a measure by means of which a connection of two rail-like profile elements ensures a precise transition of the ratchet or toothed rack compartment, i.e., that the ratchet or toothed rack compartment is guided with equidistant spacing from one element to the next.

The stated object is achieved according to the invention by use of a connection according to the invention as disclosed herein.

It is provided that the guide elements or profiles have pattern elements next to the ratchet or toothed rack compartment, extending in the longitudinal direction of the profile, and the individual elements are in the same relation to the ratchet or toothed rack compartment, the elements preferably being aligned on the ratchet or toothed rack compartment. For the connection, a connecting element is provided which likewise has further pattern elements which extend in the longitudinal direction along a longitudinal wall, and which are congruent with the pattern elements in the guide profiles.

If the pattern elements are hole patterns, for example, the connecting element is connected to each of the two profile elements via the hole patterns, using rivet or screw elements, for example, whereby no perforation of the pattern in the connecting element remains uncovered between the two profile ends. Because of the continuity of the pattern elements of the hole pattern from one profile to the next over the elements, i.e., the hole pattern in the connecting element, it is ensured that the transition in the ratchet or toothed rack compartment maintains equidistant spacing from one profile to the next.

As pattern elements, cams or elevations are also possible which project outwardly from the longitudinal wall with spring loading, for example, and which engage in corresponding hole patterns in the longitudinal wall adjacent thereto, for example to fixedly connect the connecting element to one of the profile elements. Instead of holes, however, merely punched depressions may be provided as pattern elements, in which the referenced elevations or cams engage to secure the connecting element to the profile.

Instead of a ratchet or toothed rack compartment, longitudinally extending coding may also be provided, along which a device, means of transport, or the like may be guided or driven. But also in the case of coding it is important for the transition from one profile element to the next to take place uniformly or consistently, which in turn may be carried out using the referenced pattern elements such as, for example, a hole pattern over the connecting element situated between the profiles.

The rail-like profile may have a U-, H-, T-, V-, L-, or O-shaped cross section, i.e., an open or closed cross section. The ratchet, toothed rack compartment, or coding extends in at least one longitudinally running wall, and the pattern elements such as the hole pattern, which are linearly arranged, for example, extend in at least one further longitudinal wall; i.e., one element of each pattern, such as a hole, comes to rest precisely next to each opening or section of the ratchet, toothed rack compartment, or coding. The connecting element may also have a corresponding U-, H-, T-, V-, L-, or O-shaped design, or may be designed as a two-dimensional longitudinal rail.

Such rail-like profiles may be manufactured from extruded steel or aluminum, for example, or may be made of another suitable material such as a reinforced polymer. For example, aramid fiber-or carbon fiber-reinforced polymers, such as acetals, polyamides, etc., are known which are extremely dimensionally stable, have high abrasion resistance, are impact-resistant, etc., and which are correspondingly suited as replacement materials for metals. Other polymeric materials having a much lower weight are currently being developed as replacements for metallic materials.

The selection of material depends on the use of the rail, for example as a guide for a vehicle, access equipment, a lift, rescue equipment, transport equipment, etc.

BRIEF DESCRIPTION OF DRAWINGS

The invention is explained in greater detail with reference to the accompanying figures.

DETAILED DESCRIPTION

Figure 1:
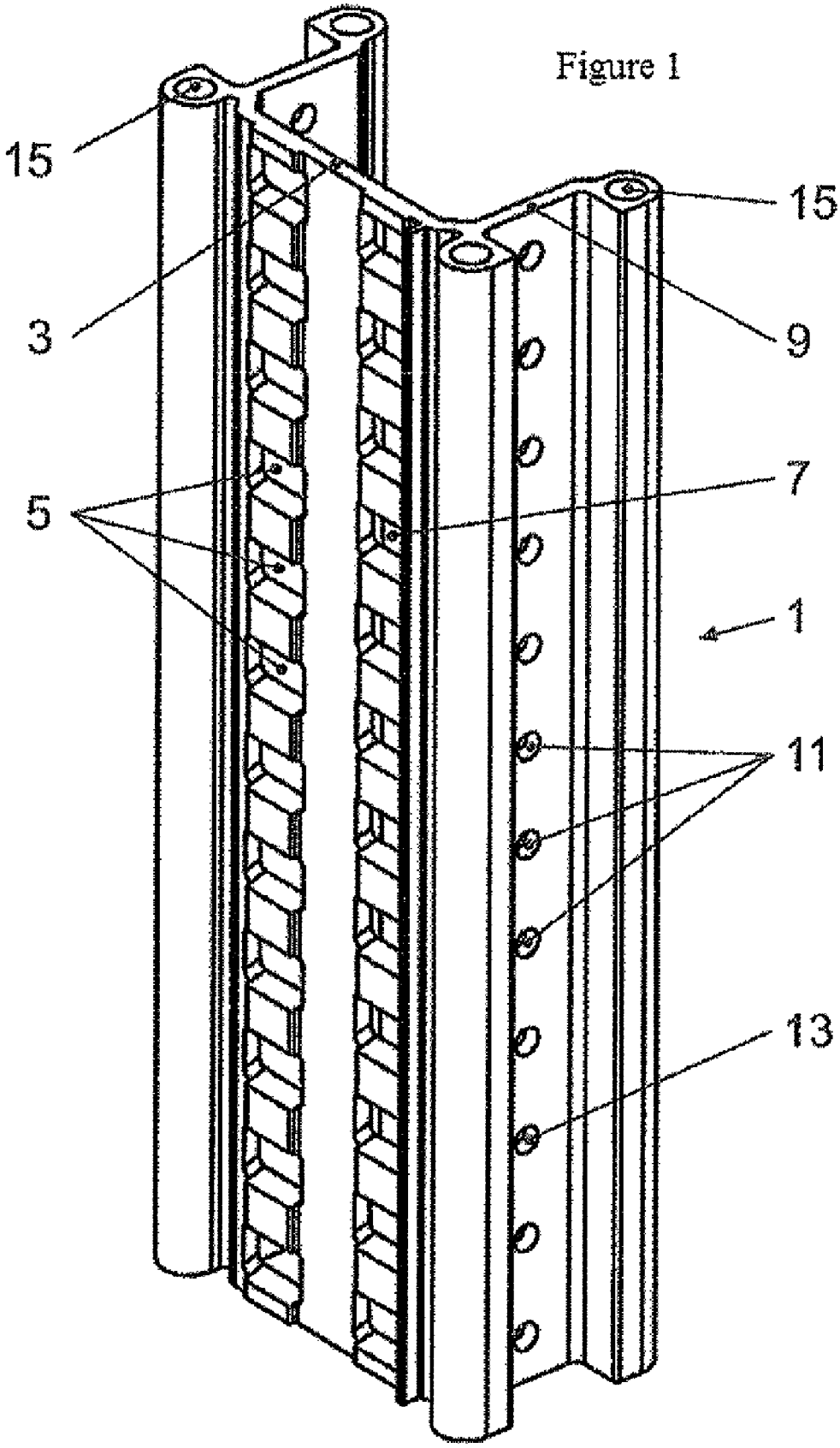
FIG. 1 shows a perspective view of one element of a rail-like profile.

FIG. 1 shows a perspective view of a rail-like longitudinal profile 1 which is part of a multipart rail-like guide profile and is suitable for guiding devices, vehicles, transport equipment, etc. To guide or drive such devices, vehicles, or equipment a longitudinal ratchet or toothed rack compartment 5 is provided in a wall 3 having equidistantly spaced perforations 7. A toothed gear, a stop mechanism for access equipment, etc., may engage in these perforations 7.

The guide profile 1 shown in FIG. 1 has a U-shaped design, having two lateral leg faces 9 in which a first, longitudinally extending hole pattern 11 having individual perforations 13 is provided. Lastly, tubular guides 15 are provided on which guide rollers, retaining gliders, or the like are guided or which engage with same.

Figure 2:
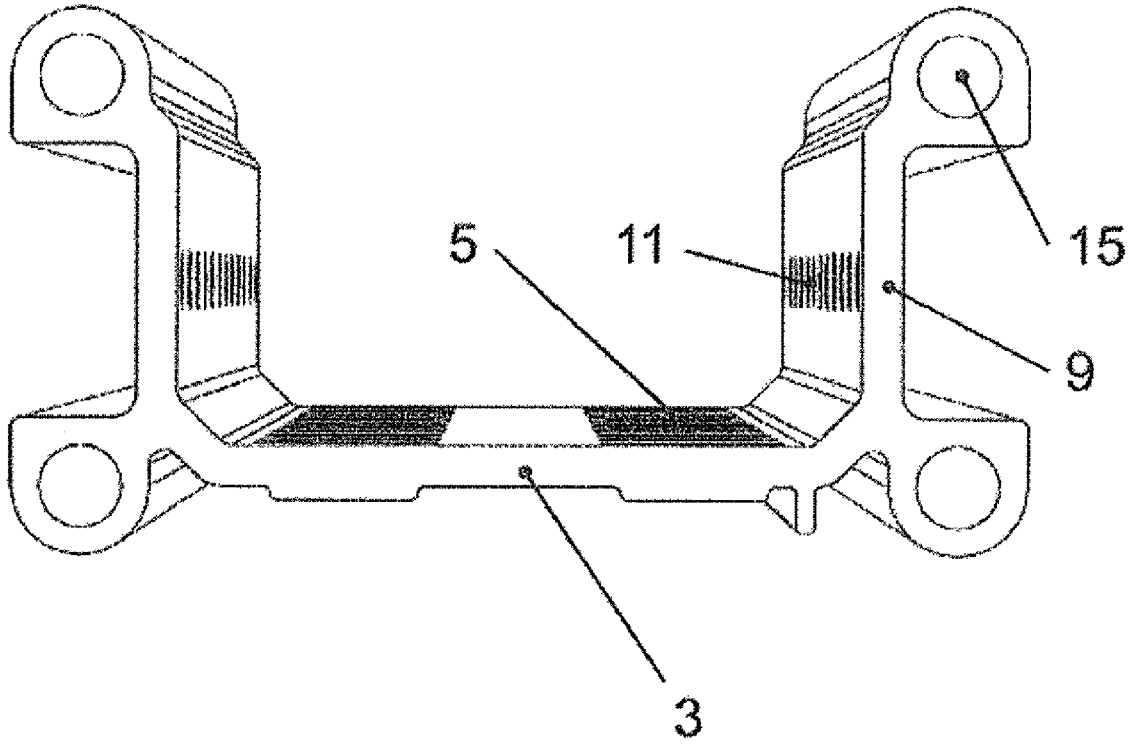
FIG. 2 shows the element from FIG. 1 in a cross sectional perspective view.

FIG. 2 illustrates a perspective cross sectional view of the rail-like guide profile 1 from FIG. 1, in this case the U-shaped cross section being clearly discernable.

In order to join two rail-like guide profiles together in such a way that the ratchet or toothed rack compartment 5 is continued with equidistant spacing from one profile to the next, it is important that the two elements which are to be joined together are cut off precisely, so that on the connecting surface the distance between two ratchet holes is the same as that along the rail-like profiles. In practice, however, this is achievable, if at all, only by using complicated, extremely accurate cutting and joining equipment.

Figure 3:
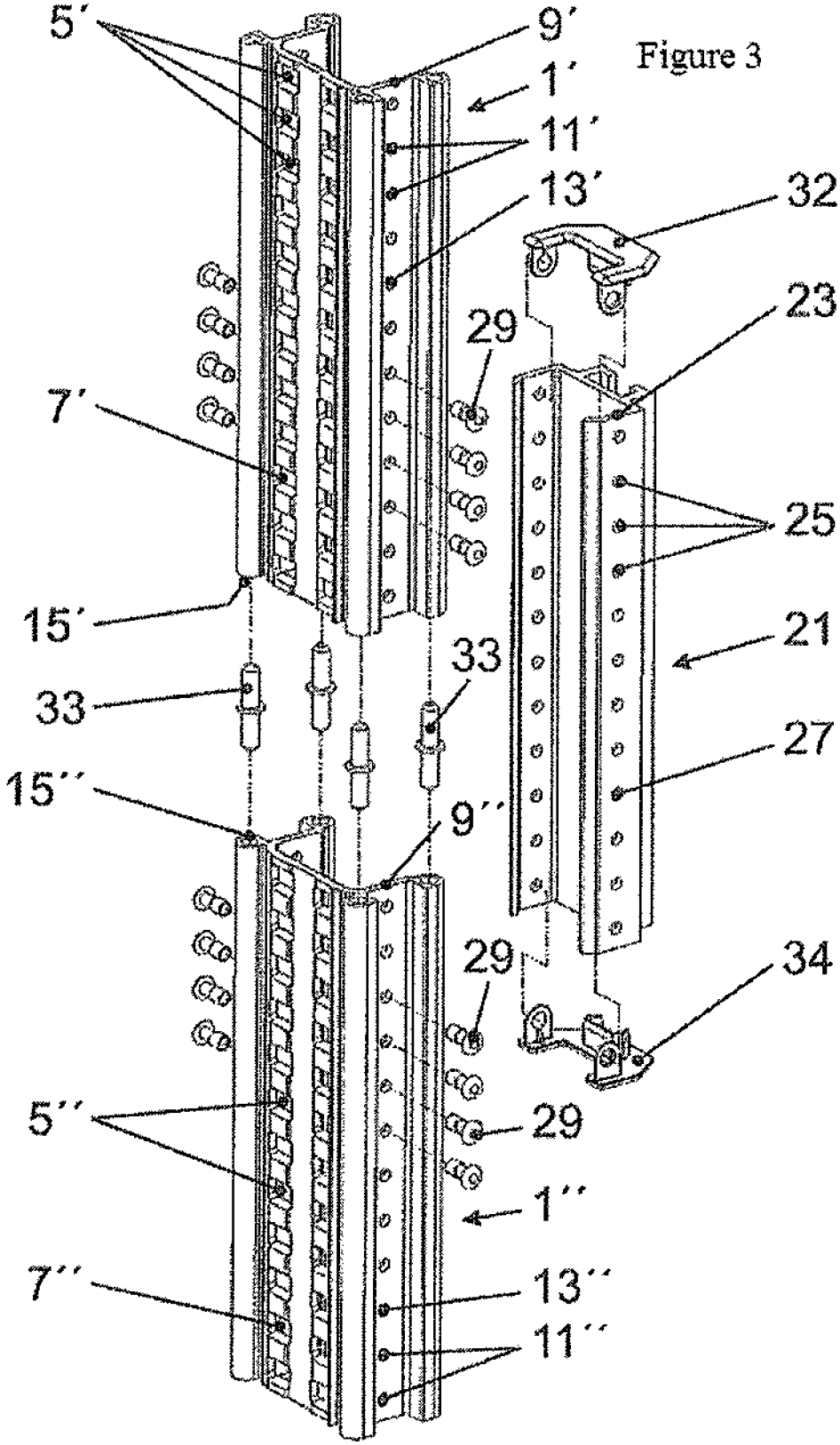
FIG. 3 shows a schematic perspective of two rail-like profiles to be connected, and the connecting element provided for the connection.

To enable a precise connection to be established, the invention provides for the use of at least one connecting element as schematically illustrated in a perspective view in FIG. 3. The two profile elements 1' and 1" illustrated in FIG. 3 are to be joined together in such a way that the respective ratchets 5' and 5" remain equidistant in the transition from one profile element to the next. In other words, the transition of the ratchets should be uniform so that the transition of, for example, a toothed gear engaging in the ratchets proceeds from one profile to the next without problems. To connect the two profile elements 1' and 1", a connecting element 21 is provided which likewise has a U-shaped design, for example with a mirror-symmetrical configuration with respect to the two profiles.

A second longitudinally extending hole pattern 25 having individual perforations 27 and in each case extending in the longitudinal direction is likewise provided in the two side legs 23 of the U-shaped connecting element 21. The individual perforations 27 are exactly the same, i.e., have at least substantially the same hole cross section, design, and spacing as the individual perforations 13' and 13" of the first hole pattern 11' and 11" in the side legs 9' and 9" of the respective rail-like profiles 1' and 1".

Figure 4:
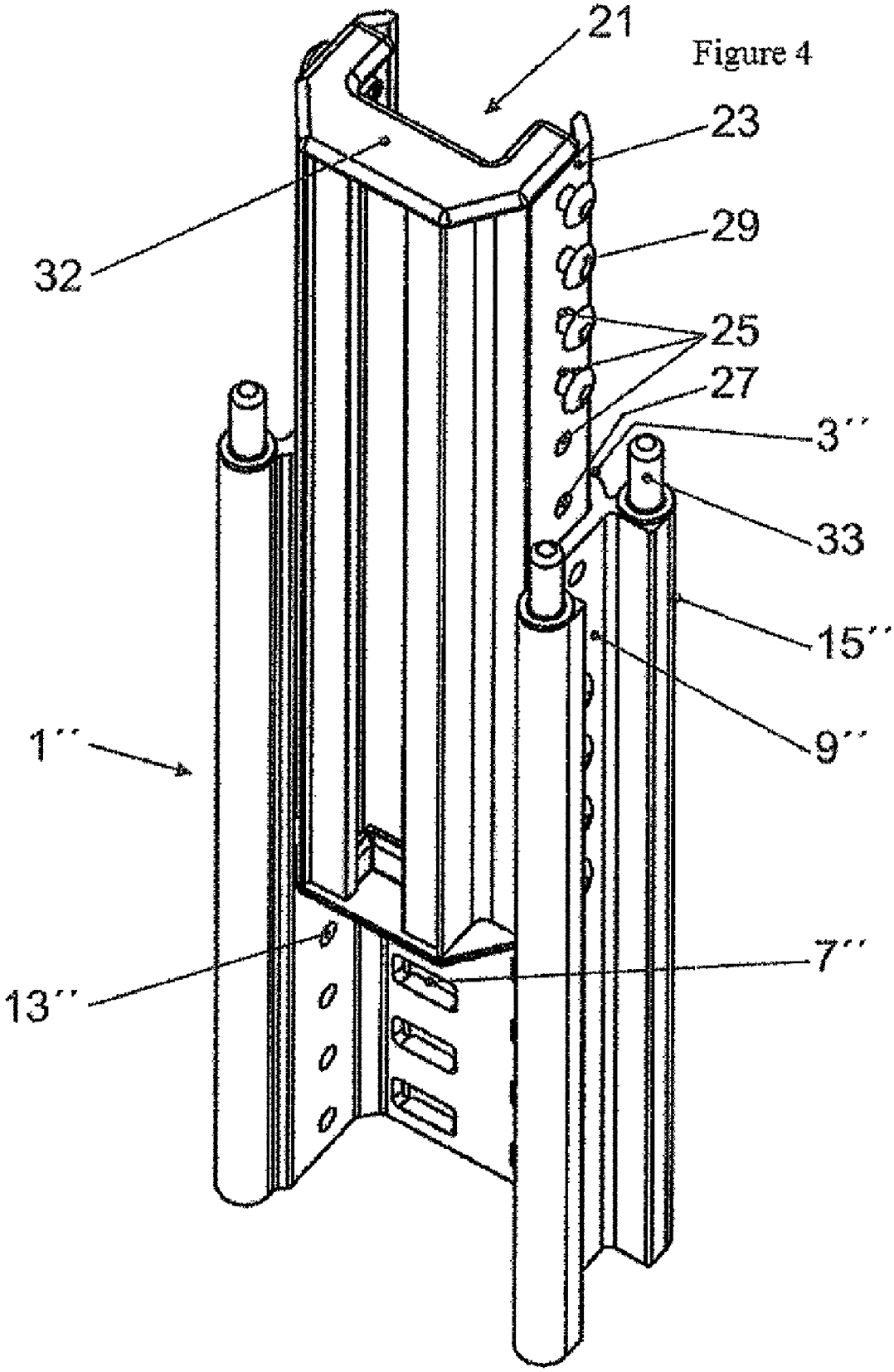
FIG. 4 shows a connecting element inserted into a rail-like profile as illustrated in FIGS. 1 and 2.

Correspondingly, the connecting element 21, initially as illustrated in FIG. 4, is provided in the U-shaped longitudinal channel of the profile 1" in such a way that the perforations of the two hole patterns are aligned exactly one on top of the other, thus allowing the connecting element 21 to be connected to the rail-like profile 1", for example by use of the rivets 29 illustrated in FIGS. 3 and 4. Such rivets 29 may be easily introduced, for example, using a battery-operated riveting gun.

The use of rivets to connect the connecting element to the rail profiles may be advantageous, especially when high strength is required. In contrast to the use of screw connections, when a rivet is affixed its cross section expands inside the perforation, and the rivet is compressed in the cross-sectional area of the perforation. Thus, the perforation is completely filled when the rivet is set. In addition, when a rivet is set the two parts to be connected, such as the profile wall and the wall of the connecting element, are initially guided toward one another and finally are fully pressed together. When a screw connection is used, there is no complete and compressive filling of the perforations. Thus, higher strength results when rivets are used, and in addition the two parts to be connected adhere much more strongly to one another. Specifically for the rail-like profiles described according to the invention, increased strength in the region of the connection of the two profiles may be an important factor.

Top covers and cover caps 32 and 34 are provided on the respective ends of the connecting element 21.

After the connecting element 21 has been affixed to the rail-like profile 1", the further rail-like profile 1' may be guided over the connecting element 21, thus allowing the longitudinal tubes 15' provided in the corners of the U-shaped profile to be guided over projecting pins 33 situated in the longitudinal tubes 15" of the other rail-like profile 1" in order to establish a connection.

Figure 5:
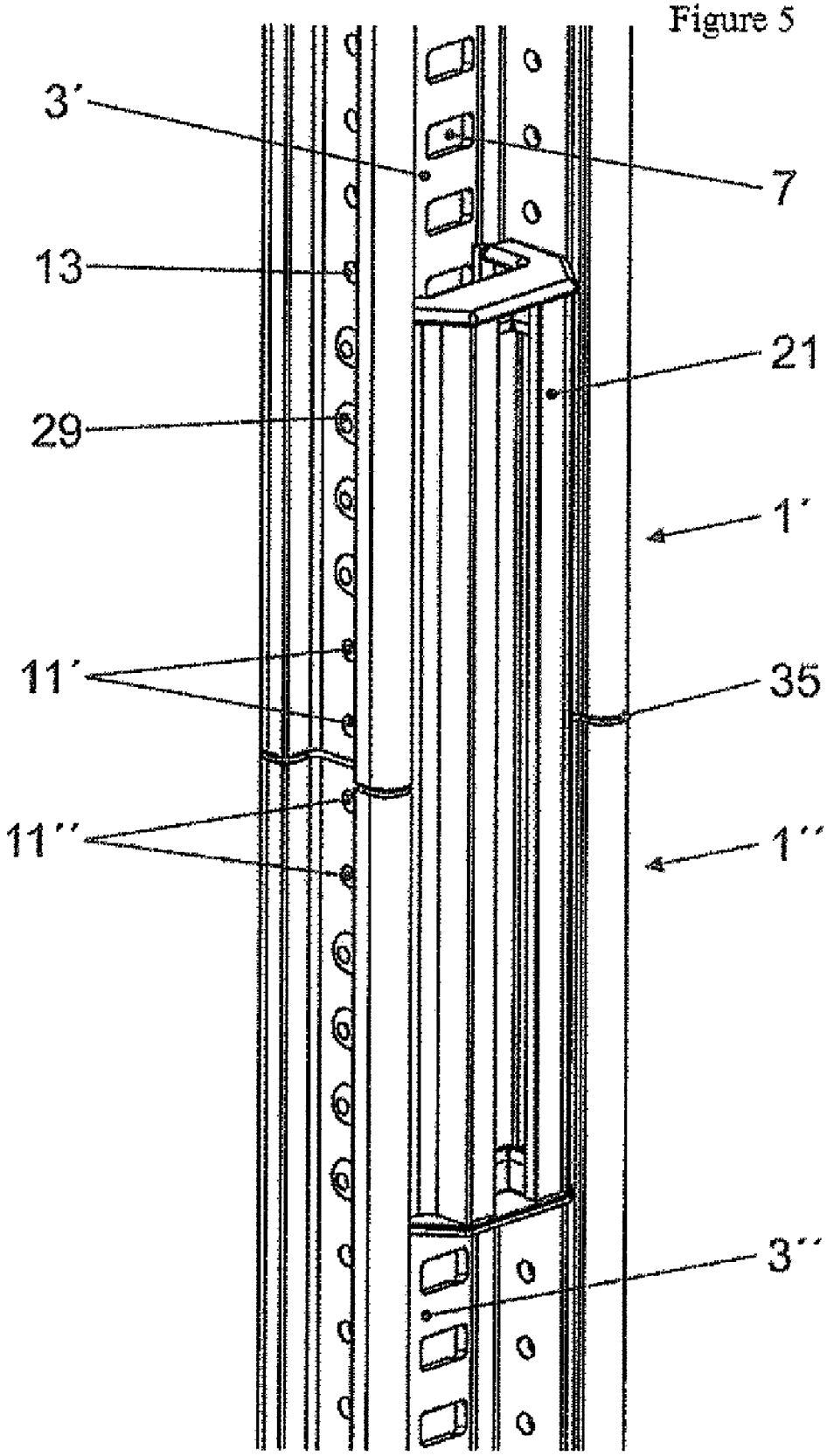
FIG. 5 shows two rail-like profiles joined together using a connecting element according to the invention.

FIG. 5 shows a perspective view once again of the two rail-like profiles 1' and 1" in the joined state, with the connecting element 21 situated in the connection. The hole pattern of the connecting element 21 is congruent with each of the two hole patterns 11' and 11", the connection between the connecting element 21 and the two rail-like profiles 1' and 1" being established via the previously mentioned rivet connections 29.

Due to the fact that the two hole patterns 11' and 11" are continued equidistantly from one rail-like profile to the next, it is also ensured that the ratchet situated in the end face 3' or 3" is continued equidistantly from one profile to the next. The gap 35 which results between the two rail-like profiles may be different for the various transitions, but the ratchet or toothed rack compartment always continues consistently from one profile to the next.

Figure 6:
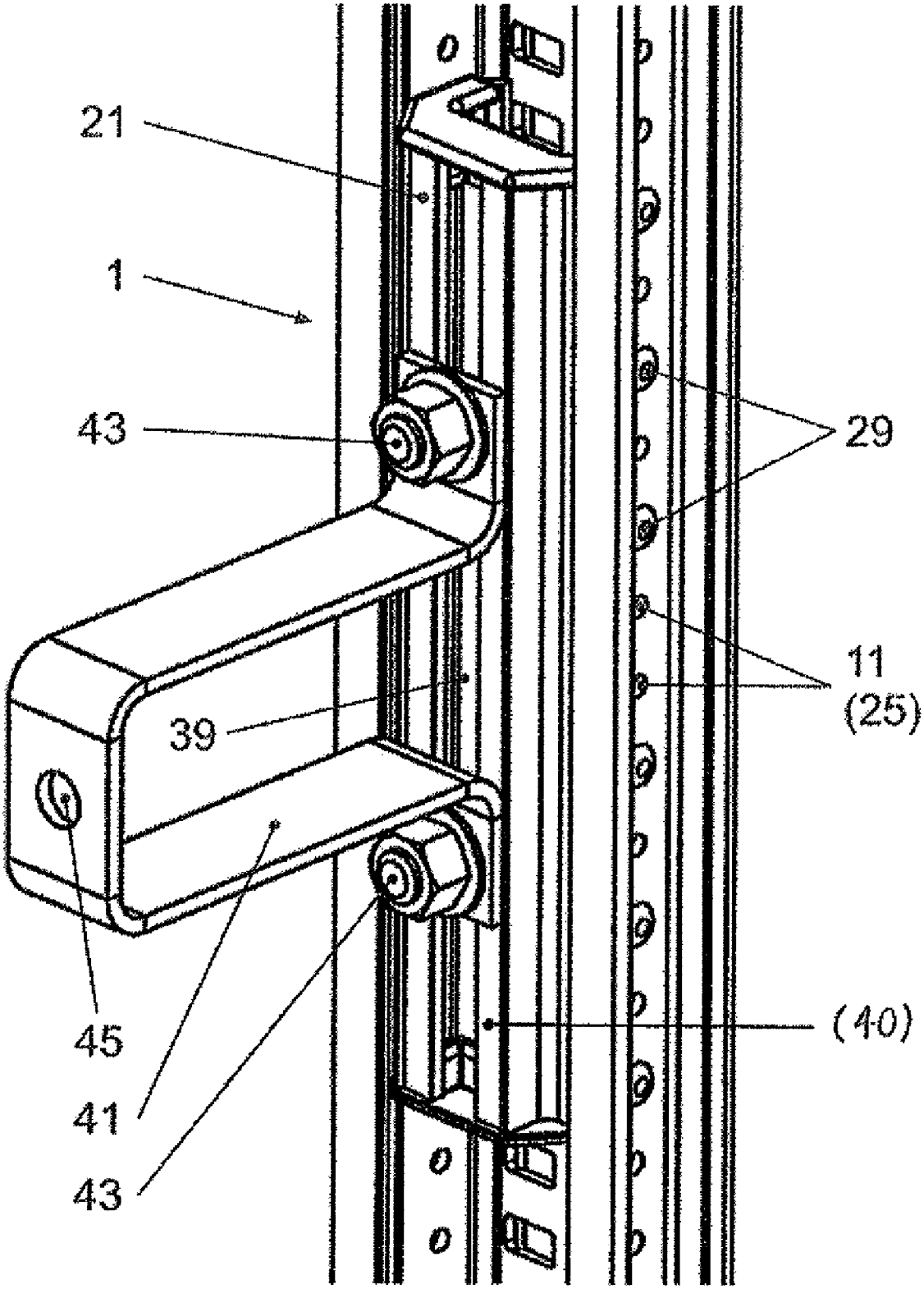
FIG. 6 shows use of the connecting element for fastening the rail-like profile, for example to a substrate on a building wall, transmission line tower, etc.

As stated at the outset, such rail-like guide profiles may be used for guiding or driving transport equipment, vehicles such as rail vehicles, access equipment, etc. The use of such rail-like profiles is known, for example, for guiding access equipment and lifts on the walls of houses, transmission line towers, for guiding rescue equipment, etc. It is important that the individual rail-like profiles as well as the entire multipart rail-like profile in particular can be stably mounted or installed on a substrate such as, for example, a wall of a house, a transmission line tower, a cable railway pylon, etc. This may also be ensured, for example, using the above-referenced connecting element according to the invention. Correspondingly, by way of example FIG. 6 shows, once again in perspective view, a mounting or retaining element 41 which is suitable for mounting or securing to a transmission line tower. This mounting element 41 may be fastened or secured, via screw connections 43, for example, to a corresponding mounting longitudinal groove 39 in the connecting element 21 which is centrally provided between each of the laterally projecting longitudinal flanks 40, the mounting element 41 having a fastening region 45 through which the rail-like profile may be fastened or mounted on a substrate, once again via a screw connection.

On account of this dual function of the connecting element, the connecting element may also be provided at any location on the rail-like guide profile in order to mount the guide profile on a house facade or a transmission line tower. In other words, connecting elements which also have a mounting element may be situated along the rail-like guide profile, i.e., not in the region of the connection of two rail-like guide profiles, to additionally increase the mounting strength of the rail-like guide profiles.

FIGS. 1 through 6 show only one example of the connection of two rail-like profile elements of a multipart guide profile, which is used to explain the present invention in greater detail. In particular, the U-shaped rail-like profile shown is strictly an example, and the present invention may of course be applied to an H-shaped, T-shaped, V-shaped, or other design of a multipart, rail-like, open or closed longitudinal profile. In addition, the selection of materials as such is unimportant, so that the profile may be made of extruded stainless steel, aluminum, or another material such as a reinforced polymeric material, for example.

Correspondingly, the connecting element may be V-shaped, H-shaped, T-shaped, U-shaped, L-shaped, open, closed, or designed as a two-dimensional longitudinal plate. In addition, the rail-like guide profile is not limited to any particular use; it may be designed strictly in the form of a toothed rack as a drive mechanism for a vehicle, or as a guide and drive rail for access equipment, for a lift, etc.

Instead of a ratchet or toothed rack compartment, any other divisions of the profile provided in the longitudinal direction may be selected, in particular codings, which are stored on longitudinally extending magnetic strips. These codings are designed similarly to the ratchet as uniform, periodically recurring pattern elements which correspondingly continue or are to be transferred uniformly, also in the transition from one profile element to the next. In this case as well, it is practical to use the connecting element provided according to the invention.

As previously mentioned, it is also not absolutely necessary to use the hole pattern described in the examples; rather, equidistantly spaced elevations, cams, or the like may be used which engage in corresponding depressions. These elevations or cams may be situated either in the rail-like profile elements, with the depressions or recesses correspondingly provided in the connecting element, or vice versa. These cams may also be pretensioned in an outwardly projecting manner, and may snap or lock, for example, into the corresponding recesses when the connecting element is inserted into the profiles.

The multipart rail-like profile provided according to the invention is particularly suited for climbing aids or access equipment as described in International Patent applications WO 2005/016461 and WO 2007/051341.

It is important that a longitudinally extending ratchet, toothed rack compartment, or coding is provided in the multipart guide profile, and that longitudinally extending pattern elements, which are aligned on the ratchet, toothed rack compartment, or coding or match same. Also provided is a connecting element for connecting two rail-like profiles, which likewise has pattern elements which extend in the longitudinal direction and are in a consistent relation to the pattern elements in the rail-like profile elements, such as congruency, for example.

The invention claimed is:

1. Multipart, longitudinally extending rail-like profile comprising:

at least two or more joinable or insertable, longitudinally extending profile elements each having at least one ratchet, a toothed rack compartment, or codings extending in the longitudinal direction, first, longitudinally extending pattern elements having equidistantly spaced elements extending in the longitudinally direction in at least one wall of each profile element coupled to the ratchet or toothed rack compartment or codings, and a connecting element for connection of two adjoining profile elements, the connecting element having a further wall provided for adjoining the wall of each of two adjoining profile elements, the further wall of the connecting element having second, longitudinally extending pattern elements which are congruent with the first, longitudinally extending pattern elements, the elements of the second, longitudinally extending pattern elements having matching spacing with the elements of the first, longitudinally extending pattern elements.

2. Profile according to claim 1, wherein the first pattern elements and the second pattern elements are hole patterns with perforations.

3. Profile according to claim 2, further comprising connecting members to connect the perforations of the hole pattern in the profile elements to the perforations of the hole pattern in the connecting element.

4. Profile according to claim 3, wherein the cross section of the connecting element is such that it is possible to push in or push on the profile elements, so that the walls having the pattern elements in the profile elements together with the further wall of the connecting element having the second pattern elements lie on or against one another with congruence of the individual elements of the patterns.

5. Profile according to claim 3, wherein the connecting members are selected from the group consisting of rivets, screws, and guide pins.

6. Profile according to claim 1, wherein the first pattern elements, and the second pattern elements are spaced identically to the spacing between perforations of the ratchet, individual teeth of the toothed rack compartment, or elements of the codings, or are spaced at an interval which is a multiple thereof, and are aligned on the ratchet perforations or the toothed rack compartment teeth or the coding elements.

7. Profile according to claim 1, wherein the profile elements have a cross-section selected from the group consisting of a U-, H-, T-, V-, L-, and O-shaped cross section.

8. Profile according to claim 1, wherein the cross section of the profile elements has a U-shape, and the cross section of the connecting element has a mirror-symmetrical U-shape, such that the connecting element may be pushed or inserted into the U-shaped channel in the profile elements in a mirror-symmetrical manner.

9. Profile according to claim 1, wherein the profile elements as well as the connecting element are made of extruded steel or aluminum, and all the elements are made of the same material.

10. Profile according to claim 1, wherein two adjoining profile elements are connected to one another by a connecting element to form a connection for guiding or driving vehicles or access equipment, for a lift, for rescue equipment, or a transport device.

11. Profile according to claim 1, wherein the connecting element has a mounting section for fixedly mounting the rail-like profile on a substrate selected from the group consisting of a wall of a house, a transmission line tower, and a cable railway pylon.

12. Profile according to claim 11, wherein the mounting section is formed by a longitudinal groove provided between laterally projecting longitudinal flanks which may be engaged from the rear from the direction of the substrate, wherein at least one mounting element may be fixedly positioned in the longitudinal groove which engages with the longitudinal flanks from the rear in order to affix the rail-like profile to or on a substrate.

13. Method for connecting at least two longitudinally extending profile elements of a multipart rail-like profile, each of the profile elements having first pattern elements in the longitudinal direction in the profile elements, the multipart profile further including a longitudinally extending connecting element which has second pattern elements, provided in the longitudinal direction, the method comprising:

inserting or placing the connecting element between two profile elements, with the individual elements of the second pattern elements being congruent or equidistantly spaced the same as the individual elements in the first pattern elements of the profile elements, and connecting the two profile elements to the connecting element by at least one of rivets, screw connections, plugs, and guide pins, in such a way that no second pattern elements in the connecting element remain uncovered between the profile elements.

14. The method according to claim 13, wherein the first pattern elements and the second pattern elements are hole patterns with perforations.

* * * * *